US007581493B2

(12) United States Patent
Miescher et al.

(10) Patent No.: US 7,581,493 B2
(45) Date of Patent: Sep. 1, 2009

(54) DEVICE AND METHOD FOR PLACING A ROLL AGAINST/REMOVING IT FROM A PRINTING PRESS

(75) Inventors: Andres Miescher, Urtenen (CH); Andreas Zahnd, Zollikofen (CH)

(73) Assignee: WIFAG Maschinenfabrik AG, Bern (CH)

( * ) Notice: Subject to any disclaimer, the term of this patent is extended or adjusted under 35 U.S.C. 154(b) by 377 days.

(21) Appl. No.: 10/542,692

(22) PCT Filed: Aug. 27, 2004

(86) PCT No.: PCT/CH2004/000540

§ 371 (c)(1),
(2), (4) Date: Jul. 19, 2005

(87) PCT Pub. No.: WO2005/021264

PCT Pub. Date: Mar. 10, 2005

(65) Prior Publication Data

US 2006/0124005 A1 Jun. 15, 2006

(30) Foreign Application Priority Data

Sep. 1, 2003 (DE) ..... 103 40 183

(51) Int. Cl.
*B41F 13/24* (2006.01)
*B41F 31/00* (2006.01)
*B41F 31/30* (2006.01)

(52) U.S. Cl. ..... 101/247; 101/352.04; 101/349.1; 101/139; 101/352.02

(58) Field of Classification Search .....
101/352.01–352.05, 247, 139, 207–210, 101/216, 349.1, 351.1–351.4, 352.09, 148, 101/350.1
See application file for complete search history.

(56) References Cited

U.S. PATENT DOCUMENTS

| | | | | |
|---|---|---|---|---|
| 3,934,508 | A | 1/1976 | Heimlicher | 101/349 |
| 5,081,927 | A * | 1/1992 | Jahn | 101/218 |
| 5,142,977 | A * | 9/1992 | Gertsch et al. | 101/148 |
| 5,375,522 | A * | 12/1994 | Junghans | 101/424 |
| 5,806,428 | A | 9/1998 | Koppelkamm et al. | 101/352.04 |
| 7,124,683 | B2 * | 10/2006 | Faist et al. | 101/247 |

FOREIGN PATENT DOCUMENTS

| | | |
|---|---|---|
| DE | 93 16 916.7 | 3/1994 |
| DE | 197 30 681 A1 | 4/1998 |
| DE | 198 11 053 A1 | 9/1999 |
| EP | 1 155 843 A2 | 11/2001 |

* cited by examiner

*Primary Examiner*—Judy Nguyen
*Assistant Examiner*—Marissa L Ferguson-Samreth
(74) *Attorney, Agent, or Firm*—McGlew and Tuttle, P.C.

(57) ABSTRACT

A device is provided for engaging and/or disengaging a roller with or from a first mating roller. The device includes a second mating roller, with which the roller is engaged, and with a basic unit, with which the roller can be moved to or away from the first mating roller in the circumferential direction of the second mating roller. A process for engaging and/or disengaging a roller of a printing press with or from a first mating roller is provided wherein the roller is engaged with a second mating roller and the roller is guided in the circumferential direction of the second mating roller in the state in which it is engaged with the second mating roller.

19 Claims, 4 Drawing Sheets

DEVICE AND METHOD FOR PLACING A ROLL AGAINST/REMOVING IT FROM A PRINTING PRESS

CROSS REFERENCE TO RELATED APPLICATIONS

This application is a United States National Phase application of International Application PCT/CH2004/000540 and claims the benefit of priority under 35 U.S.C. § 119 of German Application DE 103 40 183.0 filed Sep. 1, 2003, the entire contents of which are incorporated herein by reference.

FIELD OF THE INVENTION

The present invention pertains to a device and a process for engaging and disengaging a roller of a printing press with and from a mating roller.

BACKGROUND OF THE INVENTION

It is frequently necessary during the printing operation to engage and disengage individual rollers with and from other rollers. Individual rollers, e.g., an applicator roller, are engaged in such cases simultaneously with both a plate cylinder and a distributor roller, and a so-called "nip," i.e., a contact surface, at which the surfaces of the rollers that are in contact with one another touch each other, is formed in the area of the contact between two rollers that are in contact with one another. It is generally preferred that a roller be in contact with a mating roller with the most constant pressure possible.

A device for mounting and positioning a roller of a printing press, in which the roller is engaged with at least one mating roller and is mounted on both sides in a bearing shell, is known from the Applicant's DE 198 11 053 A1, whose teaching concerning the mounting and positioning of a roller is included in this application. These bearing shells are connected with a press frame by means of at least one spring element.

FIG. 3 shows a so-called intermediate roller 1, which is engaged with two stationary mating cylinders 3 and 4. The intermediate roller 1 is engaged with the mating rollers 3 and 4 usually along the bisecting line of the angle of the triangle formed by the axes of rotation of the rollers 1, 3 and 4, starting from the axis of rotation of roller 1, between the two axes of rotation of the rollers 3 and 4 and it comes simultaneously in contact with the mating rollers 3 and 4.

SUMMARY OF THE INVENTION

The object of the present invention is to provide a device and a process for engaging and/or disengaging a roller of a printing press with/from a mating roller, which make possible rapid engagement and disengagement operations.

According to the invention, a device is provided for engaging and/or disengaging a roller with or from a first mating roller. The device includes a second mating roller, with which the roller is engaged, and a basic unit, with which the roller can be moved to or away from the first mating roller in the circumferential direction of the second mating roller.

According to a further aspect of he invention, a process for engaging and/or disengaging a roller of a printing press with or from a first mating roller is provided wherein the roller is engaged with a second mating roller and the roller is guided in the circumferential direction of the second mating roller in the state in which it is engaged with the second mating roller.

A roller shall be engaged according to the present invention such that it is in contact with at least two rollers in the engaged state. This happens, e.g., in the case of an applicator roller that shall be in contact with a distributor roller and a plate cylinder.

The device according to the present invention for engaging and/or disengaging a roller of a printing press with or from a first mating roller, so that the roller is in contact with the first mating roller and with a second mating roller in the engaged state, has a basic unit, with which the roller can be guided or moved in the circumferential direction or in the tangential direction of the second mating roller such that the roller is preferably continuously in contact with the second mating roller and can thus be moved, e.g., along a circular path in the direction of the first mating roller until the roller comes into contact with the first mating roller. Likewise, the roller can also be moved away from the first mating roller with the basic unit. The basic unit provided according to the present invention is consequently designed such that the roller can be mounted or guided along the second mating roller such that at least one partial area of the surface of the roller and of the second mating roller preferably touch each other without interruption, i.e., that the roller is preferably engaged continuously with the second mating roller. As a result, the roller can already rotate together with the second mating roller in contact with it and if, e.g., an applicator roller is in contact with a distributor roller and is guided along the surface of the distributor roller for engaging with a plate cylinder, the applicator roller can be prevented from running dry. Thus, the roller needs to be engaged according to the present invention with a single mating roller only, because it is preferably already in continuous contact with the second mating roller.

Thus, it is possible according to the present invention to set the contact between the roller and the mating roller that is in contact therewith already before the roller is engaged with the additional mating roller. For example, the nip can already be set and only a single engaging operation with an additional mating roller is necessary to bring the roller into contact with two mating rollers.

Thus, control units for positioning the roller to be engaged can be simplified with the device according to the present invention and, e.g., electric motors and potentiometers for the simultaneous engagement of the roller with two mating rollers in the correct position with correspondingly complicated actuating mechanisms can be eliminated.

The device according to the present invention for engaging and/or disengaging a roller with or from a mating roller may be provided, in principle, for every individual roller of a printing press. The present invention is preferably used for at least one, several or each rubber cylinder, for example, in the inking system and/or in the dampening system. For example, rider rollers, distributor rollers, ink applicator rollers and/or other rollers that are directly or indirectly adjacent to the rollers can be engaged or disengaged with the device according to the present invention or with the process according to the present invention. It is possible, in principle, with the device according to the present invention or with the process according to the present invention to engage or disengage one, two or even more rollers in a printing press or in a printing couple with or from one, two or more than two mating rollers together or independently from one another.

The basic unit advantageously has a pneumatic element for adjusting the basic unit, as a result of which very fast engaging and/or disengaging movements can be carried out and it is thus possible, e.g., to embody steep run-up sequences with a minimum amount of spoilage or fast disengagement operations, e.g., in case of an emergency stop, while curling in inking systems is avoided at the same time.

To move the roller in the circumferential direction of the second mating roller, the basic unit can be preferably adjusted transversely, i.e., at right angles to a radial direction or in parallel to a tangential direction of the second mating roller. As a result, it becomes possible to set any desired nip ratio between the roller and the first and second mating cylinders. If the basic unit is moved, for example, to a mating roller in a straight-line continuation of a tangential direction, the pressure distribution on the contact surfaces of the roller on the first and second mating cylinders can be set and it can thus be ensured, for example, that the same nip is always present at the contact points on the first and second mating rollers. For example, the nip ratio between an applicator roller and a plate cylinder or the distributor roller can be set or adjusted in one embodiment by a corresponding transverse adjustment of the basic unit in relation to the distributor roller and/or to the plate cylinder.

A feed unit is advantageously provided, which is in connection with the roller or in which the roller is mounted and with which, e.g., an engaging pressure of the roller on one or two mating rollers can be set or generated. The feed unit may be connected, e.g., rotatably or rigidly to the basic unit.

The feed unit preferably has a carriage for this purpose, on which pressure is applied, e.g., by a spring or another suitable element and can mount the roller, e.g., an applicator roller, in the known manner in two half shells.

A setting element, e.g., an adjusting spindle, is advantageously provided, with which a pressure, e.g., the spring pressure on the carriage, can be changed in order to set the engaging pressure of the roller mounted in the carriage on the mating cylinder or mating cylinders can be set and, for example, desired nip widths can be achieved at the mating cylinders, i.e., for example, at the plate cylinder and at the distributor roller, The feed unit is preferably located in the axis of the bisecting line of the angle between the first and second mating cylinders, i.e., for example, between the plate cylinder and the distributor roller, e.g., in the engaged state, as a result of which the engaging pressure generated by the feed unit and acting on the roller acts approximately uniformly on the two mating cylinders, so that the nip ratio between the mating cylinders is approximately equal. However, the nip ratio can be changed by deflecting the feed unit or the element provided for generating the engaging pressure, for example, a spring, from the mentioned bisecting line of the angle in order to generate, for example, a greater nip width in one mating cylinder than in another mating cylinder.

The basic unit and the feed unit are preferably coupled with one another and are advantageously mounted such that they are rotatable in relation to one another, so that, for example, the roller is connected to the basic unit via the feed unit and the basic unit can guide the roller together with the feed unit in the circumferential direction of the second mating roller such that the roller is engaged with or disengaged from the first mating roller. The feed unit can now be rotated into such a position that a spring element present in the feed unit presses a carriage carrying the roller such that a desired nip ratio can be achieved.

Thus, rollers can be engaged and disengaged very rapidly by means of the device according to the present invention, and it is possible to set a nip or even a nip ratio that is preserved regardless of the velocity, heating of the rollers or in case of a possible swelling or shrinkage or can also be regulated automatically. It is thus possible to embody an applicator roller bearing that automatically compensates the nip, and the nips can also be adapted to changes within certain limits.

Printing units with plate cylinders with very small channel widths, e.g., with a minigap slot splitting, or channelless plate cylinders, e.g., of the sleeve design, are advantageously used. It can be ensured as a result that channel beat, which could lead to vibrations, does not practically occur on the roller, which is pretensioned by a spring, e.g., the applicator roller.

The present invention also pertains, furthermore, to a process for engaging and/or disengaging a roller of a printing press with or from a first mating roller, wherein the roller is engaged with a second mating roller and the roller is guided in the engaged state in the tangential or circumferential direction of the second mating roller until the roller is engaged or in contact with the first mating roller or is disengaged therefrom.

The roller now remains continuously in contact with the second mating roller, i.e., a partial area of the roller is in contact with a partial area of the second mating roller.

The nip, a nip ratio or the pressing pressure or the engaging pressure of the roller can be especially preferably set on one or two mating rollers, e.g., by setting or changing a force acting on the roller in a suitable manner.

The present invention will be described below on the basis of a preferred embodiment. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
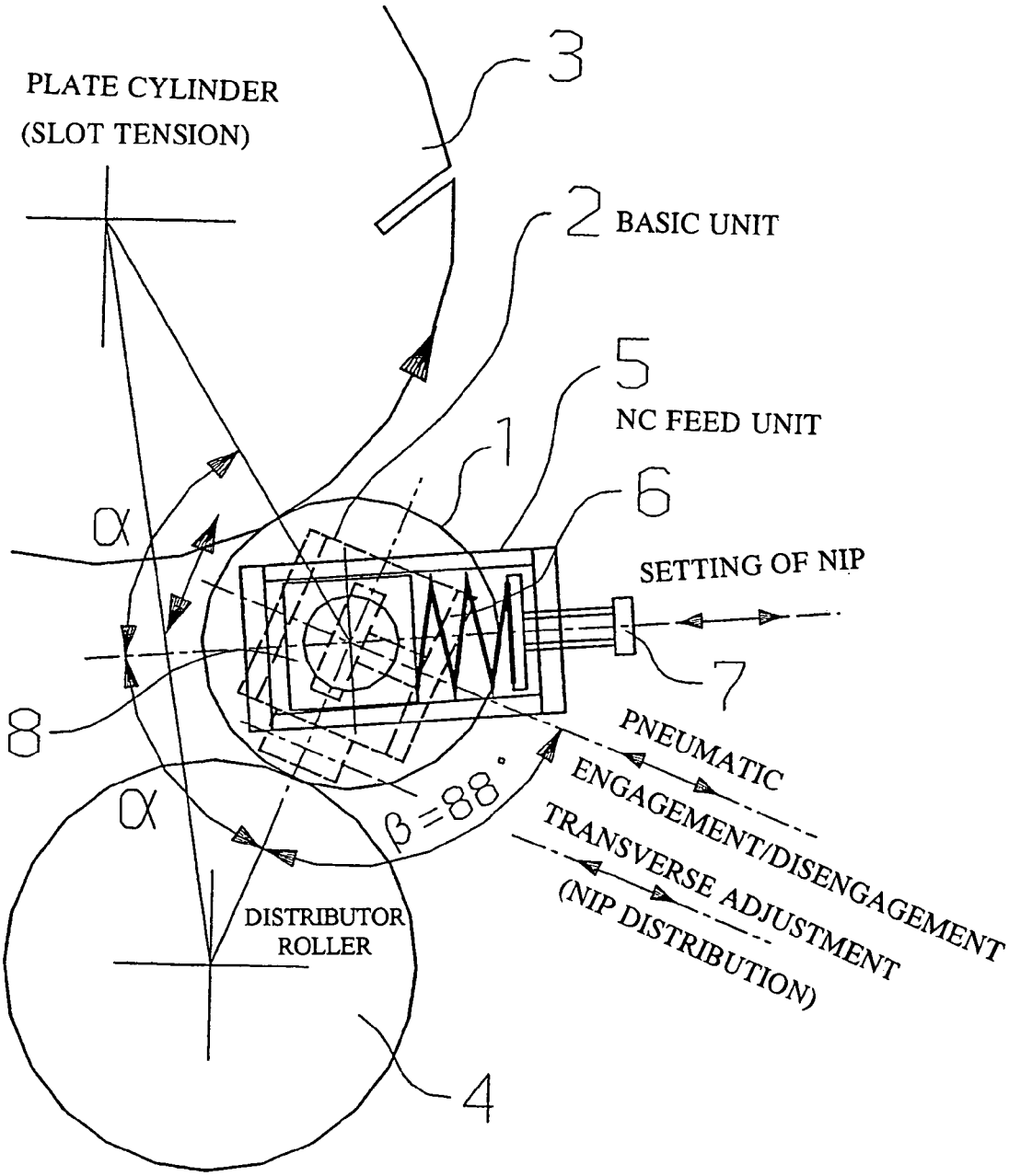
FIG. 1 is a schematic diagram of a pneumatic NC applicator roller bearing.

Referring to the drawings in particular, FIG. 1 shows an embodiment of a device according to the present invention with an applicator roller 1, which can be adjusted by a basic unit 2 along the surface of the distributor roller 4 acting as a second mating cylinder. The basic unit 2 can be moved according to the present invention preferably pneumatically such that the feed unit 5, in which the applicator roller 1 is mounted, is moved such that the applicator roller 1 is guided along the circumference of the distributor roller 4 until the applicator roller 1 is engaged with the plate cylinder 3 provided as the first mating cylinder. The applicator roller thus remains continuously in contact with the distributor roller 4, as a result of which the applicator roller 1 is prevented from running dry.

The basic unit 2 can be adjusted transversely in the direction indicated by the arrows A in order to set a desired nip ratio between the applicator roller 1 and the plate cylinder 3 or the distributor roller 4 by such a transverse adjustment.

The feed unit 5, mounted rotatably in the basic unit 2, has a spring element, which generates a spring pressure on a carriage 8, wherein the thickness of the spring pressure generated by the spring 6 can be set by means of the adjusting spindle 7. The applicator roller 1 is mounted by means of the carriage 8 in two half shells in the known manner. A nip ratio of about 1:1 can be achieved if the feed unit 5 is on the axis of the bisecting line of the angle, which bisects the angle $2\alpha$ that is formed by the centers of the plate cylinder 3, the applicator roller 1 and the distributor roller 4, i.e., if the spring element 6 preferably lies on the bisecting line of the angle such that a pressure that acts approximately equally on the plate cylinder 3 and on the distributor roller 4. Another nip ratio can be set by deflecting the feed unit 5 or the spring element 6 pressing the carriage 8 from the bisecting line of the angle.

Figure 2:
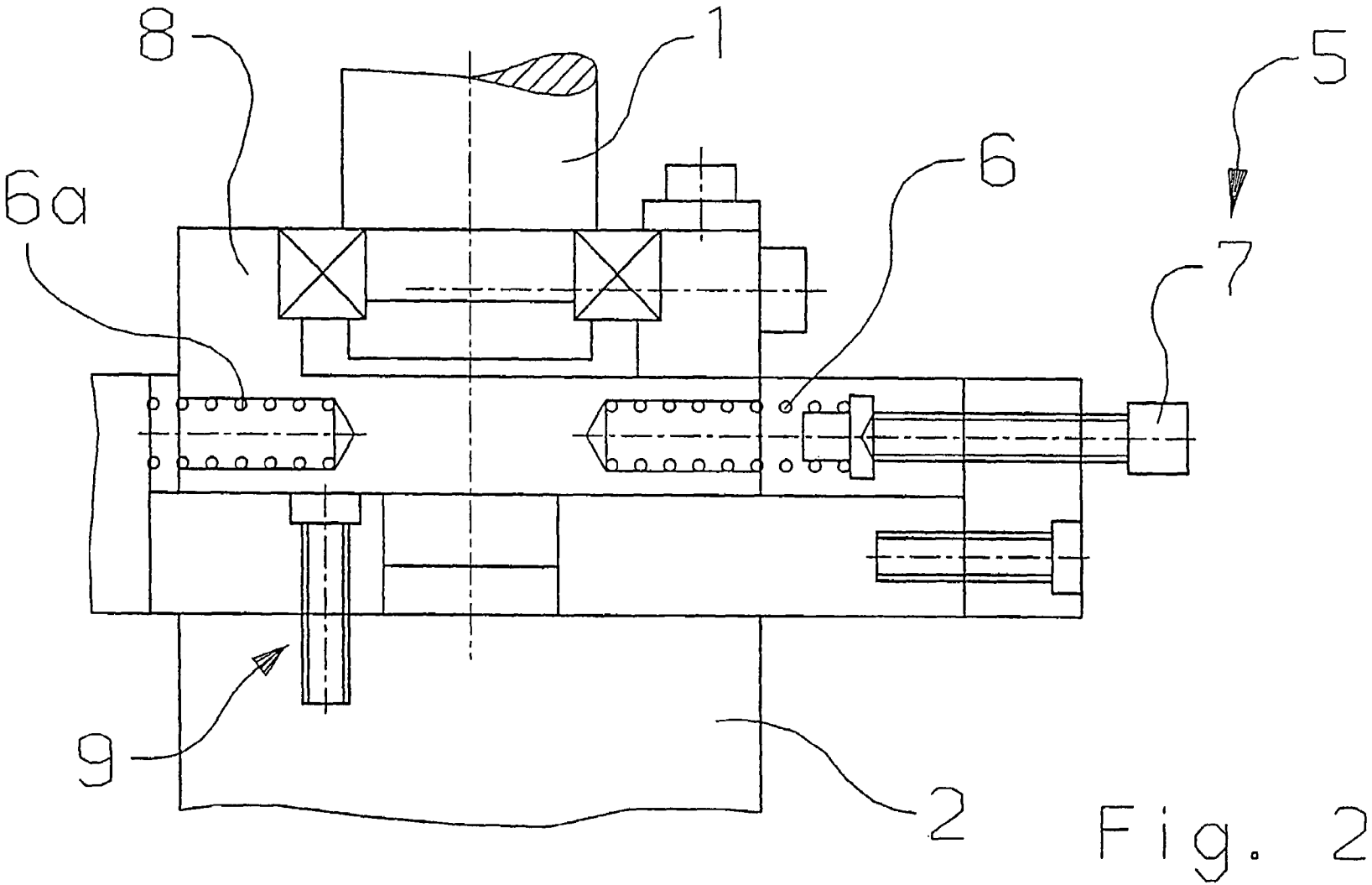
FIG. 2 is a schematic view of an NC feed unit.
Figure 3:
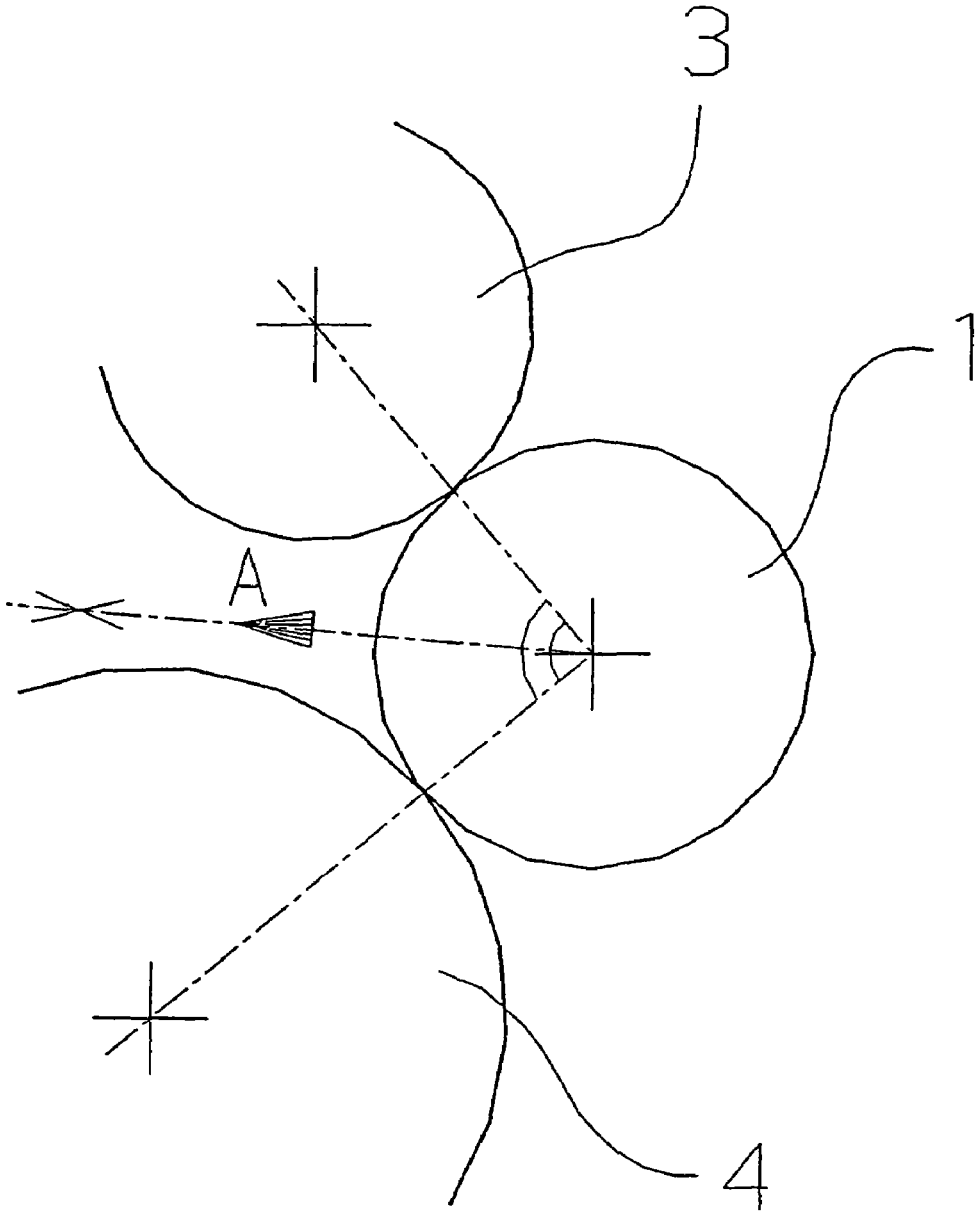
FIG. 3 is an intermediate roller engaged with two stationary mating rollers.

FIG. 2 shows the feed unit 5, which is connected by a hinge 9 to the basic unit 2 and is mounted rotatably in same.

An adjusting spindle 7, with which the pressure acting on the spring 6 can be set, is provided at the feed unit 5. The spring 6 presses the carriage 8, and an opposite spring 6*a* may be optionally provided, which likewise presses the carriage 8 in order to compensate, e.g., the weight of the applicator roller 1. The applicator roller 1 is mounted rotatably in the carriage 8 and can thus be engaged or disengaged, e.g., pneumatically in an approximately tangential direction in relation to the distributor roller 4, and the nip at the plate cylinder 3 and/or at the distributor roller 4 and, in case of a suitable position of the spring 6 or of the feed unit 5, also the nip ratio can be set by pretensioning the spring 6, which is advantageously arranged approximately along the above-described bisecting line of the angle between the plate cylinder 3 and the distributor roller 4.

For example, the applicator roller 1 and the distributor roller 4 are in functional connection and there is no functional connection between the applicator roller 1 and the plate cylinder 3 during the run-up of the printing press. At the beginning of the printing operation, the applicator roller 1 is engaged with the plate cylinder 3 while maintaining the functional connection with the distributor roller 4 and is again disengaged from the plate cylinder 3, e.g., to perform a washing operation, in order to be then in functional connection with the distributor roller 4 only.

Figure 4:
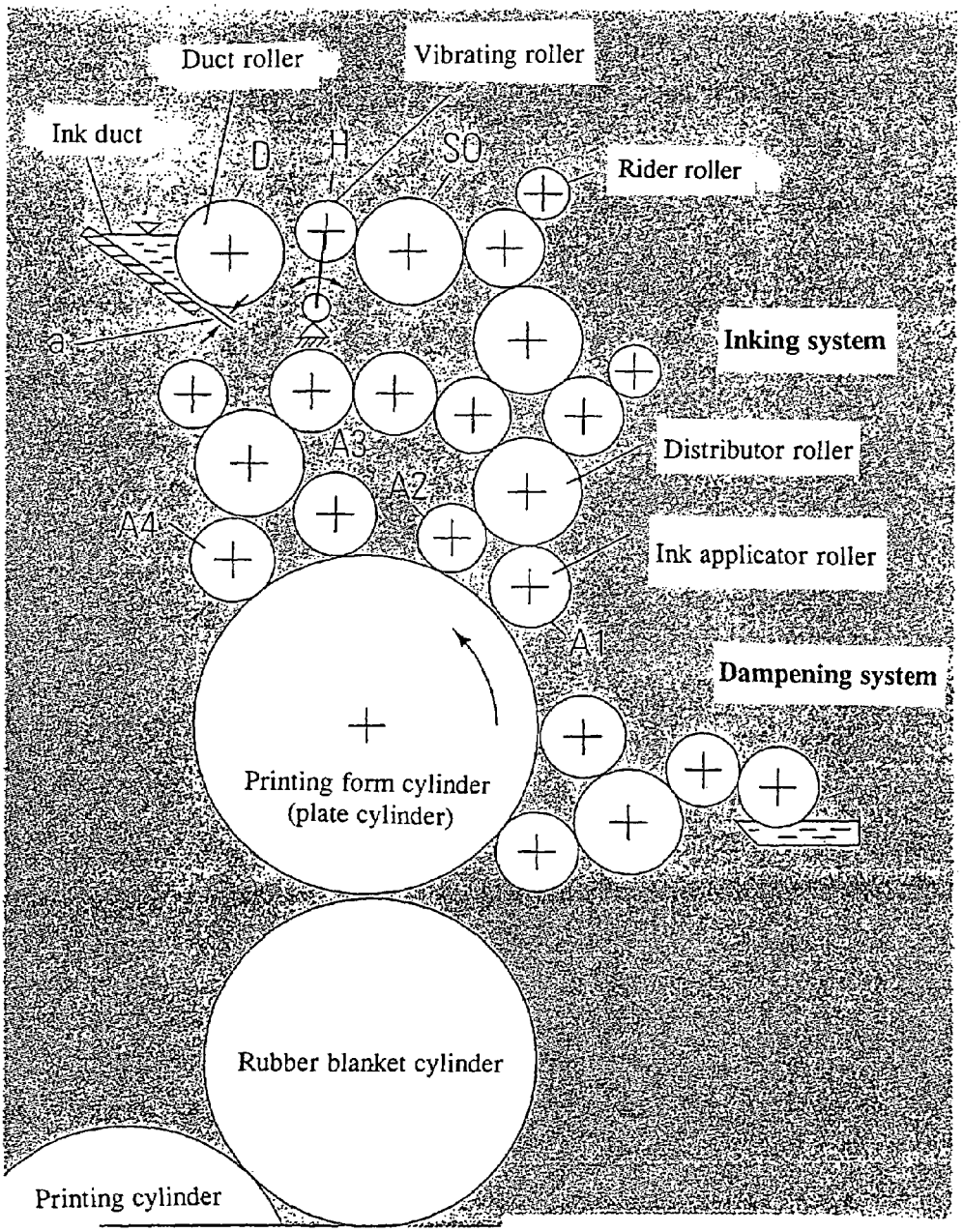
FIG. 4 is a schematic diagram of an inking and dampening system of an offset printing press.

FIG. 4 shows a schematic view of an inking and dampening system of an offset printing press and shows as an example rollers that are engaged and/or disengaged with the device according to the present invention or the process according to the present invention. In particular, the rollers mentioned by name and/or also rollers that are directly or indirectly adjacent to same can also be engaged or disengaged with the device according to the present invention with the mating cylinders shown.

Even though it was described in the exemplary embodiment that the applicator roller 1 is guided along the distributor roller 4 in order to engage this applicator roller with the plate cylinder 3, the reverse procedure is possible, in principle, as well.

While specific embodiments of the invention have been shown and described in detail to illustrate the application of the principles of the invention, it will be understood that the invention may be embodied otherwise without departing from such principles.

The invention claimed is:

1. A device for engaging and/or disengaging a roller with or from a first mating cylinder, with a second mating cylinder having a circumferential surface defining a second mating cylinder circumferential direction and defining a tangential direction to said circumferential direction, with which the roller is engaged, the device comprising:

a feed unit, said roller being mounted on said feed unit;

a basic unit connected to said roller via said feed unit, said basic unit guiding said roller together with said feed unit in a direction parallel to said tangential direction of said second mating cylinder such that said basic unit moves said roller from a first position to a second position, said roller continuously engaging the second mating cylinder when said basic unit moves said roller from said first position to said second position, said roller being in contact with the first mating cylinder and the second mating cylinder in said second position, said roller being in contact with the second mating cylinder when said roller is in said first position, said roller being at a spaced location from the first mating cylinder when said roller is in said first position, said feed unit being positioned in a bisecting line position with a rotational axis between the first mating cylinder and the second mating cylinder when said roller is in said second position, said feed unit generating engaging pressure with which said roller acts approximately uniformly on the first mating cylinder and the second mating cylinder when said feed unit is in said bisecting line position such that a nip ratio between the first mating cylinder and the second mating cylinder is substantially equal.

2. A device in accordance with claim 1, wherein the basic unit has a pneumatic adjusting element.

3. A device in accordance with claim 1, wherein the basic unit is adjustable in parallel to said tangential direction of the second mating cylinder for deflecting said feed unit from said bisecting line position to vary said nip ratio between said first mating cylinder and said second mating cylinder to generate a greater nip width between one of said first mating cylinder and said roller and said second mating cylinder and said roller.

4. A device in accordance with claim 1, further comprising a spring element for generating the engaging pressure of the roller.

5. A device in accordance with claim 1, with a setting element for setting the engaging pressure.

6. A device in accordance with claim 1, wherein the roller is mounted in a carriage.

7. A device in accordance with claim 1, wherein an element provided for generating the engaging pressure is deflected from said bisecting line to vary said nip ratio between said first mating cylinder and said second mating cylinder to generate a greater nip width in between one of said first mating cylinder and said roller or between said second mating cylinder and said roller.

8. A process for engaging and/or disengaging a roller of a printing press with or from a first mating roller, wherein the roller is engaged with a second mating roller, the process comprising the steps of:

guiding the roller in the circumferential direction of the second mating roller in the state in which the roller is engaged with the second mating roller;

mounting a feed unit to said roller;

moving the roller with said feed unit in a direction tangential to an outer surface of the second mating roller such that the roller moves from a first mating roller position to a second mating roller position, said roller being in contact with the first mating roller and said second mating roller when said roller is in said second mating roller position, said roller being in contact with said second mating roller when said roller is in said first mating roller position, said feed unit having a rotational axis, said rotational axis of said feed unit bisecting an angle defined between a rotational axis of the first mating roller and a rotational axis of the second mating roller when said roller is in said second position, said feed unit generating an engaging pressure when said roller is in said second mating position such that said roller applies a uniform pressure on the first mating cylinder and the second mating cylinder, wherein a nip ratio between the first mating cylinder and the second mating cylinder is approximately equal when said roller is in said second mating position.

9. A process in accordance with claim 8, wherein the roller is continuously in contact with the second mating roller.

10. A process in accordance with claim 8, wherein a nip, said nip ratio or the engaging pressure is set in the state in which the two mating rollers are engaged by said step of moving the roller in a direction tangential to an outer surface of the second mating roller.

11. A process in accordance with claim 8, further comprising:

providing a feed unit connected to a base unit and supporting said engagement roller, the base unit being connected to the roller via the feed unit and guiding of the roller together with said feed unit in the circumferential direction of said second mating roller; and applying an engaging pressure from the engagement roller on the mating rollers with the feed unit.

12. A process in accordance with claim 11, further comprising:

positioning the feed unit in a bisecting line position on a bisecting line that bisects an angle between the first mating cylinder and the second mating cylinder whereby the feed unit generated engaging pressure, in the bisecting line position, is such that said roller acts approximately uniformly on the first mating cylinder and the second mating cylinder such that a nip ratio between said first mating cylinder and said second mating cylinder is approximately equal.

13. A process in accordance with claim 12, wherein said step of moving the roller in a direction tangential to an outer surface of the second mating roller moves said feed unit from the bisecting line position to vary the nip ratio between the first mating cylinder and the second mating cylinder to generate a greater nip width in between one of the first mating cylinder and the roller and the second mating cylinder and the roller.

14. A printing press system, comprising:

a first mating roller having a first mating roller rotational axis;

a second mating roller having a circumferential surface defining a second mating roller tangential direction, said second mating roller having a second mating roller rotational axis;

an engagement roller for engaging and/or disengaging with or from the first mating roller and for engagement with the second mating roller;

a basic unit, said basic unit moving said engagement roller to or away from the first mating roller in the circumferential direction of the second mating roller, said basic unit being adjustable in position such that said basic unit moves said engagement roller in a direction parallel to said second mating roller tangential direction from a first roller position to a second roller position;

a feed unit mounted to said engagement roller, said feed unit having a feed unit rotational axis, said feed unit rotational axis bisecting an angle between said first mating roller rotational axis and said second mating roller rotational axis when said engagement roller is in said second roller position, said feed unit generating a roller engaging pressure, said roller applying said roller engaging pressure uniformly to said first mating roller and said second mating roller such that a nip ratio between said first mating roller and said second mating roller is substantially equal.

15. A system in accordance with claim 14, wherein the basic unit has a pneumatic adjusting element.

16. A system in accordance with claim 14, wherein said feed unit includes a spring element for generating the engaging pressure of the roller.

17. A system in accordance with claim 14, with a setting element for setting said engaging pressure.

18. A system in accordance with claim 14, wherein the engagement roller is mounted in a carriage.

19. A system in accordance with claim 14, further comprising a feed unit connected to said basic unit and supporting said engagement roller, said feed unit for applying an engaging pressure from said engagement roller on said mating rollers, said basic unit having a pneumatic adjusting element for adjusting the position of said basic unit in said direction parallel to said second mating roller tangential direction.

* * * * *